US005247743A

United States Patent [19]

Holloway et al.

[11] Patent Number: 5,247,743

[45] Date of Patent: Sep. 28, 1993

[54] METHOD AND APPARATUS FOR DIGGING TRENCHES

[75] Inventors: Randy J. Holloway; James E. Lowder, both of Lubbock, Tex.

[73] Assignee: Eagle-Picher Industries, Inc., Cincinnati, Ohio

[21] Appl. No.: 907,659

[22] Filed: Jul. 2, 1992

[51] Int. Cl.[5] ..... E02D 5/20

[52] U.S. Cl. ..... 37/355; 37/462; 405/267

[58] Field of Search ..... 37/86, 83, 87, 88, 89, 37/191 R, 191 A; 405/267

[56] References Cited

U.S. PATENT DOCUMENTS

| | | | |
|---|---|---|---|
| 564,696 | 7/1896 | Keithley . | |
| 1,306,350 | 6/1919 | McIntire . | |
| 1,374,093 | 4/1921 | Nordby . | |
| 1,769,074 | 7/1930 | Ruatti . | |
| 1,850,363 | 3/1932 | Vaughn . | |
| 2,048,710 | 7/1936 | Ranney . | |
| 2,052,372 | 8/1936 | Van Voorhis et al. . | |
| 2,526,176 | 10/1950 | Van Eyck . | |
| 2,714,262 | 8/1955 | Malzahn . | |
| 2,981,012 | 4/1961 | Meyer . | |
| 2,994,974 | 8/1961 | Domenighetti . | |
| 3,028,691 | 4/1962 | Jeffres | 37/191 A X |
| 3,032,899 | 5/1962 | Brinson, Sr. . | |
| 3,266,179 | 8/1966 | Golden | 37/191 R |
| 3,540,139 | 11/1970 | Gethmann et al. . | |
| 3,564,855 | 2/1971 | Morner . | |
| 3,785,071 | 1/1974 | Schaeff . | |
| 3,787,989 | 1/1974 | Heckathorn . | |
| 3,951,459 | 4/1976 | Honeycutt, Jr. . | |
| 3,986,280 | 10/1976 | Johnson . | |
| 4,043,135 | 8/1977 | Hoes et al. . | |
| 4,247,997 | 2/1981 | Paurat et al. . | |
| 4,255,883 | 3/1981 | Ealy . | |
| 4,379,658 | 4/1983 | Schmednecht . | |
| 4,681,483 | 7/1987 | Camilleri . | |
| 4,843,742 | 7/1989 | Camelleri . | |
| 4,861,199 | 8/1989 | Hackmack . | |
| 4,930,940 | 6/1990 | Charlier et al. . | |

FOREIGN PATENT DOCUMENTS

| | | | |
|---|---|---|---|
| 376533 | 5/1973 | U.S.S.R. | 37/191 |

*Primary Examiner*—Dennis L. Taylor
*Assistant Examiner*—Arlen L. Olsen
*Attorney, Agent, or Firm*—Wood, Herron & Evans

[57] ABSTRACT

A trenching apparatus comprises a boom assembly having a lower end mounted on a support base and an upper end connected to a boom mounting bracket which is joined by a coupler to a digger arm operative to form a trench alongside the support base following a trench line. Linear actuators are carried by the boom mounting bracket, the coupler and the digger arm to manipulate the digger arm about an X axis, a Y axis and a Z axis which are mutually perpendicular. Other linear actuators vertically raise and lower the boom assembly, and pivot it in an arc-shaped path relative to the support base, in the course of a trenching operation.

14 Claims, 5 Drawing Sheets

METHOD AND APPARATUS FOR DIGGING TRENCHES

FIELD OF THE INVENTION

This invention relates to apparatus and methods for forming trenches, and, more particularly, to a trenching apparatus and method capable of forming longitudinally extending trenches at the corners of an excavation site particularly where there is limited space to operate the trenching apparatus and/or wherein other structures are located in close proximity to the trenches to be formed.

BACKGROUND OF THE INVENTION

The erection of above-ground structures often requires the formation of inground retaining walls for use as a load-bearing foundation or as a barrier to prevent the collapse of soil into the excavated area. Where such excavations are made adjacent an existing structure, a retaining wall along the excavation line adjacent the existing structure is necessary to resist soil pressures established beneath the adjoining structure. If no retaining wall is formed, the soil beneath the adjoining structure can collapse outwardly into the excavation and/or damage the existing structure. In addition to the retention of soil, retaining walls of this type are often constructed to block the flow of ground water into the excavated area.

A number of methods have been employed to form retaining walls around an excavation site or adjacent structures which adjoin such site. One method is meant to employ piles formed of wood or steel which are driven along the excavation line to form the retaining wall. Alternatively, a row of bored holes are formed along the excavation line which receive reinforced concrete piles to form the retaining wall. Both of these methods produce retaining walls which are not watertight, and which may require substantial horizontal strengthening to maintain the desired alignment along the excavation line.

Trenching apparatus such as disclosed in U.S. Pat. Nos. 4,681,483 and 4,843,742, both to Camilleri, have been proposed as an alternative to the methods and apparatus of forming retaining walls mentioned above. In trenching apparatus of this type, a supporting base capable of being moved along an excavation or trench line carries an elongated trench digger arm mounted on one side thereof by a boom assembly. The support base is drivingly connected to skids or track assemblies of the type employed in conventional bulldozers or other earth moving equipment which are effective to move the support base and digger arm along the excavation line to form a trench of the desired depth. Concrete is poured into the trench immediately behind the moving trenching apparatus into which appropriate reinforcing bars are inserted so that an essentially continuously formed reinforced concrete retaining wall is provided at the excavation site.

The trenching apparatus described in U.S. Pat. No. 4,681,483 includes a boom assembly having an inner boom which telescopes in and out of an outer boom by operation of linear actuators such as hydraulic or pneumatic extension cylinders. This boom assembly is pivoted between a raised position and a lowered position relative to ground level by another linear actuator, preferably a lift cylinder mounted between the boom assembly and support base. As disclosed in the U.S. Pat. No. 4,681,483, the boom assembly is coupled to the digger arm by a manipulator or work head which provides for pivotal movement of the digger arm about an X axis, a Y axis and a Z axis, all of which are mutually perpendicular. This pivoting structure includes an hydraulic motor carried by the boom assembly having an output shaft connected to the digger arm which is rotatable about the Z axis to pivot the digger arm about such axis. Pivotal motion of the digger arm relative to the Y axis is obtained by operation of a second hydraulic motor, carried by a bracket connected to the boom assembly, whose output shaft is mounted to the digger arm and is rotatable about the Y axis. X axis pivotal motion of the digger arm is produced by operation of a linear actuator having a piston which is extendable and retractable to pivot the digger arm about a pin carried by the boom assembly.

As discussed in detail in the U.S. Pat. No. 4,681,483 patent, the linear actuators associated with the boom assembly, and the pivot mechanisms connected between the boom assembly and digger arm, cooperate to lower the digger arm from ground level to the desired trench depth, and to move the digger arm along the trench line, while continuously maintaining the digger arm in a substantially vertical attitude. Additionally, a platform which carries the boom assembly on the support base is pivotal to allow the boom assembly to swing the digger arm forwardly and rearwardly relative to the support base so that areas close to a structure adjoining the excavation site and/or areas where the trench forms a corner, can be accommodated by such trenching apparatus.

Despite the improvements provided by devices of the type disclosed in the Camilleri U.S. Pat. Nos. 4,681,483 and 4,843,742, problems have been encountered with their construction and method of operation. As mentioned above, two hydraulic motors are employed to rotate or pivot the digger arm with respect to both the Y and Z axes. Because of the substantial weight and length of the digger arm, and the depths of the trenches in at which the digger arm must be operated, it has been found that manipulation of the digger arm by hydraulic motors is not as effective as desired and can result in relatively rapid wear of the shafts, seals and bearings of such motors requiring frequent repair and/or replacement. Additionally, trenching apparatus having a rotatable platform supporting the boom assembly, such as disclosed in the Camilleri patents, adds expense to the overall system in order to obtain the desired swinging movement of the boom assembly.

SUMMARY OF THE INVENTION

It is therefore among the objectives of this invention to provide an apparatus for digging trenches with an elongated trench digger arm insertable from ground level to the desired trench depth below ground, which accurately an reliably controls the angular position of the digger arm at all stages of the digging operation, which permits the digging of trenches at the corners of an excavation site, and, which permits the digging of trenches at excavation sites where obstructions are present such as buildings located adjacent the desired trench line.

These objectives are accomplished in a trenching apparatus including a boom assembly having a lower end mounted on a support base and an upper end which carries a digger arm operative to form a trench alongside the support base following a trench line. The upper end of the boom assembly is connected to a boom mounting bracket which, in turn, carries a coupler connected to a digger arm bracket pivotally mounted to the digger arm. Linear actuators such as fluid actuated cylinders are carried by the boom mounting bracket, the coupler and the digger arm to manipulate the digger arm about an X axis, a Y axis and a Z axis which are mutually perpendicular. Additional linear actuators are provided to vertically raise and lower the boom assembly, and pivoted it in an arc-shaped path relative to the support base in the course of a trenching operation.

On aspect of this invention is predicated upon the concept of providing reliable and efficient structure for maintaining the digger arm in a substantially vertical orientation throughout a digging operation. This includes initially inserting the digger arm from ground level downwardly to the desired trench depth, and thereafter propelling the upper and lower ends of the digger arm along the trench line while maintaining the digger arm substantially vertical and perpendicular to the plane of the ground being excavated. As described in detail below, such manipulation of the digger arm is achieved by a series of linear actuators associated with the boom mounting bracket, coupler and digger arm which pivot the digger arm about the X, Y and Z axes, in combination with boom extension actuators or cylinders associated with the support base which raise and lower the boom assembly and, hence, the digger arm.

Another aspect of this invention is predicated upon the concept of providing a digging apparatus which is capable of forming a trench at a corner of an excavation site, i.e., wherein a first trench is dug along one trench line and a second trench is dug along an intersecting trench line. This is achieved in the present invention by mounting the boom assembly on a hinge which is pivotal relative to a hitch fixed to the support base. Linear actuators are effective to pivot or swing the hinge and boom assembly about the fixed hitch so that the digger arm can move forwardly and rearwardly of the support base or "slew" along each of the first trench lines while the support base remains stationary first alongside one trench and then alongside the second trench, as described in detail below. This enables intersecting trenches to be formed at a corner of an excavation site, while the support base remains stationary and spaced from each of such trenches, to prevent cave-in of the trench walls and to avoid interference between the support base and/or digger arm and obstructions such as buildings or other structures located adjacent the excavation site.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
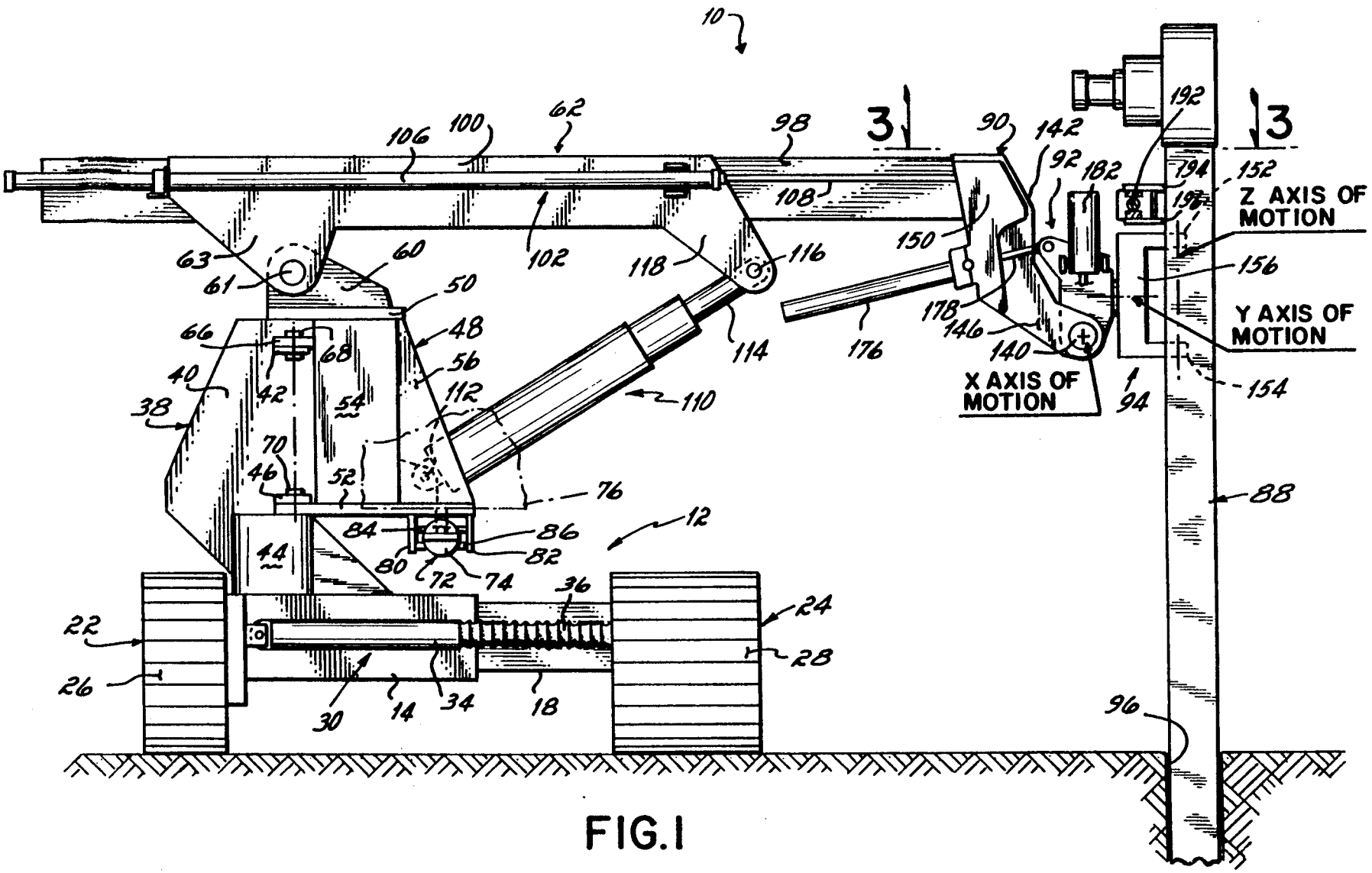
FIG. 1 is a front view of a trenching apparatus incorporating the digger arm mounting structure of this invention.

Referring now to FIG. 1, the trenching apparatus 10 comprises a support base 12, a boom assembly 62 and a digger arm 88 which cooperate to form a trench along a desired trench line in a manner such as disclosed in U.S. Pat. Nos. 4,681,483 and 4,843,742 to Camilleri. These elements are described separately below, and then a discussion is provided of the operation of apparatus 10 in connection with the formation of a corner at an excavation site where obstructions such as adjacent buildings may be present.

Support Base

Figure 5:
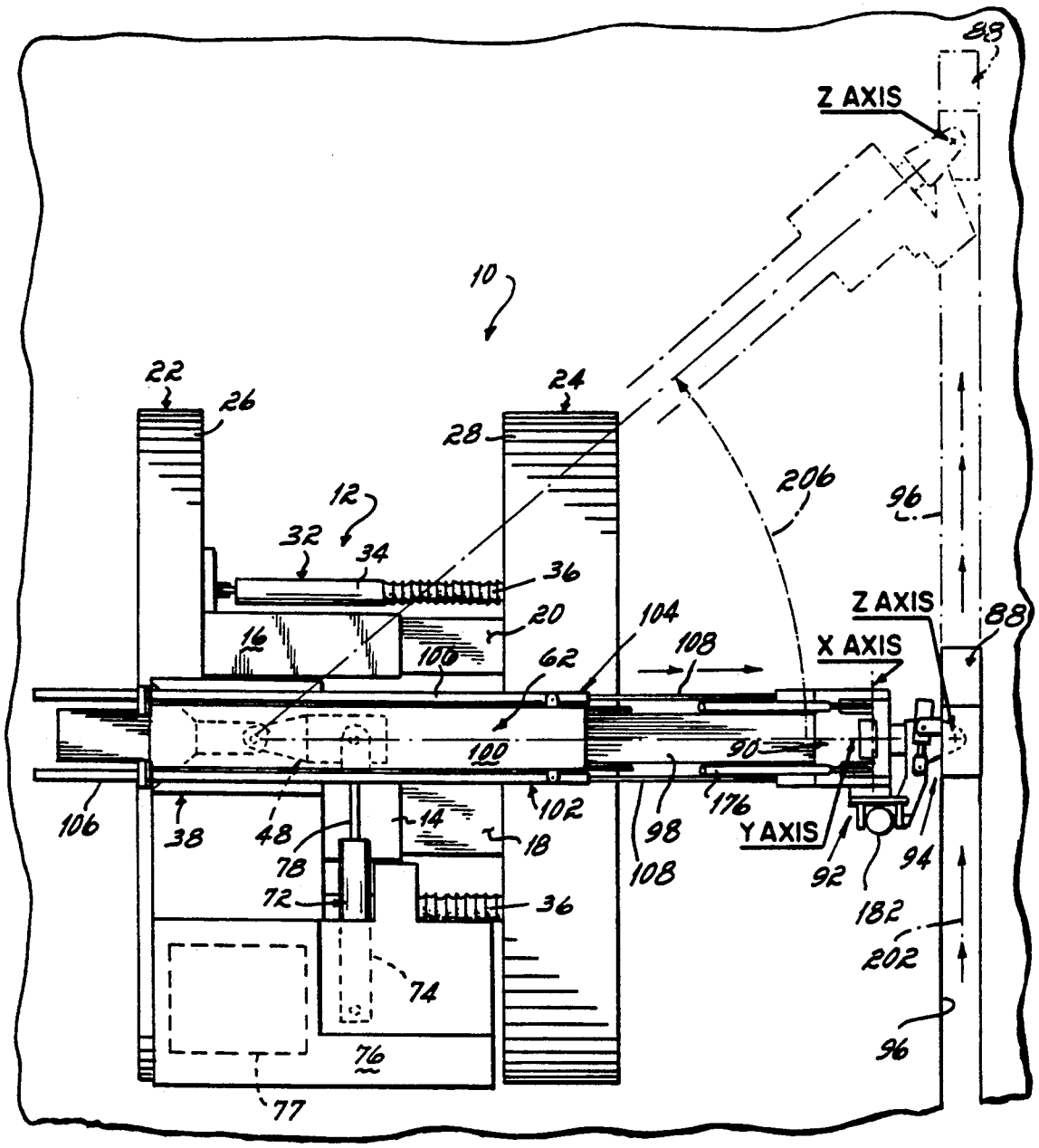
FIG. 5 is a plan view of the trenching apparatus illustrated performing a portion of a slewing operation.
Figure 6:
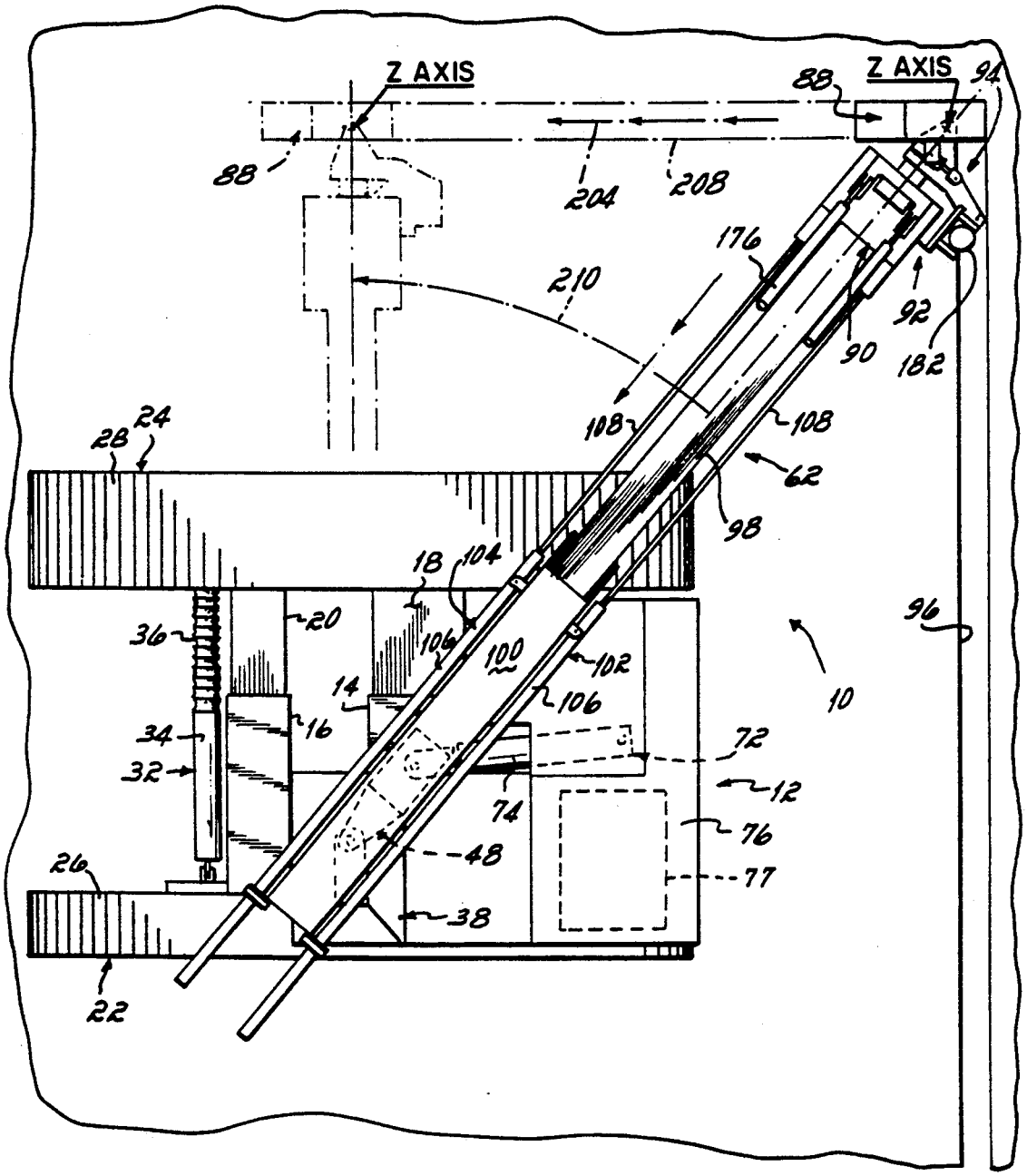
FIG. 6 is a view of the trenching apparatus performing another portion of the slewing operation for digging a corner of an excavation site.

The support base 12 is preferably of the type disclosed in U.S. patent application Ser. No. 07/696,873, filed May 8, 1991, now U.S. Pat. No. 5,189,819 and entitled "Trenching Apparatus", which is owned by the assignee of this invention and is incorporated by reference in its entirety herein. Referring now to FIGS. 1, 5 and 6 for purposes of the present discussion, the support base 12 includes a pair of sleeve members 14 and 16 which receive slider members 18 and 20, respectively. The sleeve members 14, 16 and slider members 18, 20 extend between a first track assembly 22 and a second track assembly 24 of the type conventionally utilized in excavation machinery such as bulldozers and other earth-moving equipment. The track assemblies 22, 24 each include drive rollers and sprockets (not shown) and exterior, earth-contacting grouser plates 26 and 28, respectively. The grouser plates 28 forming the outermost, earth-engaging surface of the second track assembly 24 are wider than the grouser plates 26 of first track assembly 22 for added stability and improved load transfer as described in detail in Application Serial No. 07/696,873, now U.S. Pat. No. 5,189,819.

Preferably, a pair of longitudinally spaced, pneumatically or hydraulically operated linear actuators or cylinders 30 and 32 are carried between the track assemblies 22 and 24. Each cylinder 30, 32 includes a housing 34 and an extendable cylinder rod (not shown) encased by bellows 36. In response to operation of cylinders 30, 32, the slider members 18, 20 are moved laterally within the sleeve members 14, 16, respectively. In turn, the second track assembly 24 is moved laterally relative to the first track assembly 22 between a retracted, transport position (not shown) and an extended, operating position.

The upper portion of the support base 12 mounts a hitch 38 which is fixed thereto by welding, brazing or any other essentially permanent means of attachment. The hitch 38 comprises a frame 40 carrying an upper hinge plate 42, a hinge mount or support 44 and a lower hinge plate 46. The fixed hitch 38 pivotally mounts a hinge 48 which includes an upper plate 50, a lower plate 52, an upright standard 54 and a pair of spaced gusset plates 56, one of which is shown in FIG. 1. The upper plate 50 of hinge 48 mounts a bracket 60 which is pivotally connected by a pin 61 to a second bracket 63 associated with the boom assembly 62 described separately below. The upright standard 54 has an ear 66 connected to the upper hinge plate 42 of hitch 38 by a pin 68, and the lower plate 52 of hinge 48 rests atop the hinge mount 44 of hitch 38 where it is secured thereto by a pin 70 passing through the lower hinge plate 46 of hitch 38.

The above-described connection between hinge 48 and hitch 38 at the upper and lower hinge plates 42, 46 permits pivotal or swinging motion of the hinge 48 with respect to the fixed hitch 38 for purposes described below. Such pivotal motion is initiated by a boom swing cylinder 72 best shown in FIGS. 1, 5 and 6. The boom swing cylinder 72 includes a cylinder housing 74 fixed to the support base 12. The cylinder rod 78 of the cylinder 72 is mounted to the lower plate 52 of hinge 48 by a pivot pin 73. More specifically, a pair of downwardly projecting mounting arms 80, 82 depend from plate 52 and a pair of horizontal plates 84, 86 are connected between the mounting arms 80, 82, the pin 73 passing through the plates 80 and 82. In response to extension and retraction of the cylinder rod 78, the hinge 48 is pivoted relative to the hitch 38, which, in turn, causes the boom assembly 62 to pivot or swing with respect to the support base 12. The support base 12 also carries a cowling 76 which encloses a motor 77 (shown schematically) operative to propel the support base 12 along a desired trench line in the course of a digging operation as described below.

Boom Assembly and Digger Arm

With reference to FIGS. 1–6, the boom assembly 62 and its connection to the trench digger arm 88 is illustrated in detail. Generally, the boom assembly 62 includes a boom mounting bracket 90 which is connected by a coupler 92 to a digger arm bracket 94 pivotally mounted to the digger arm 88. As described in detail below, the boom assembly 62, cooperating with structure associated with the boom mounting bracket 90, coupler 92 and digger arm bracket 94, is operative to manipulate the digger arm 88 to form a straight-line, substantially vertically oriented trench 96 along a desired trench line in a manner such as disclosed in the Camilleri patents mentioned above. This invention is primarily concerned with structure for manipulating the digger arm 88 about several axes of motion, and with a method of digging trenches utilizing such structure to form corners of excavation sites particularly where obstructions such as buildings are located nearby.

The boom assembly 62 includes an inner boom 98 having an upper end which is pivotally mounted to the boom mounting bracket 90, and a lower end which is slidably received within an outer boom 100. Telescopic movement of the inner boom 98 with respect to the outer boom 100 is obtained by operation of a pair of linear actuators 102 and 104, such as pneumatic or hydraulic extension cylinders, located on either side of the inner and outer booms 98, 100. The actuator housing 106 of each linear actuator 102, 104 is mounted to the outer boom 100, and the actuator rods 108 thereof are connected to the end of the inner boom 98 at the mounting bracket 90. A lift cylinder 110 is pivotally connected to a rod 112 extending between the gusset plates 56 of hinge 48. The cylinder rod 114 of lift cylinder 110 is connected by a pin 116 to a bracket 118 carried by the outer boom 100. As described in more detail below, the lift cylinder 110 is operative to angularly raise and lower the boom assembly 62, and, in turn, the digger arm 88, in the course of a trenching operation.

Figure 2:
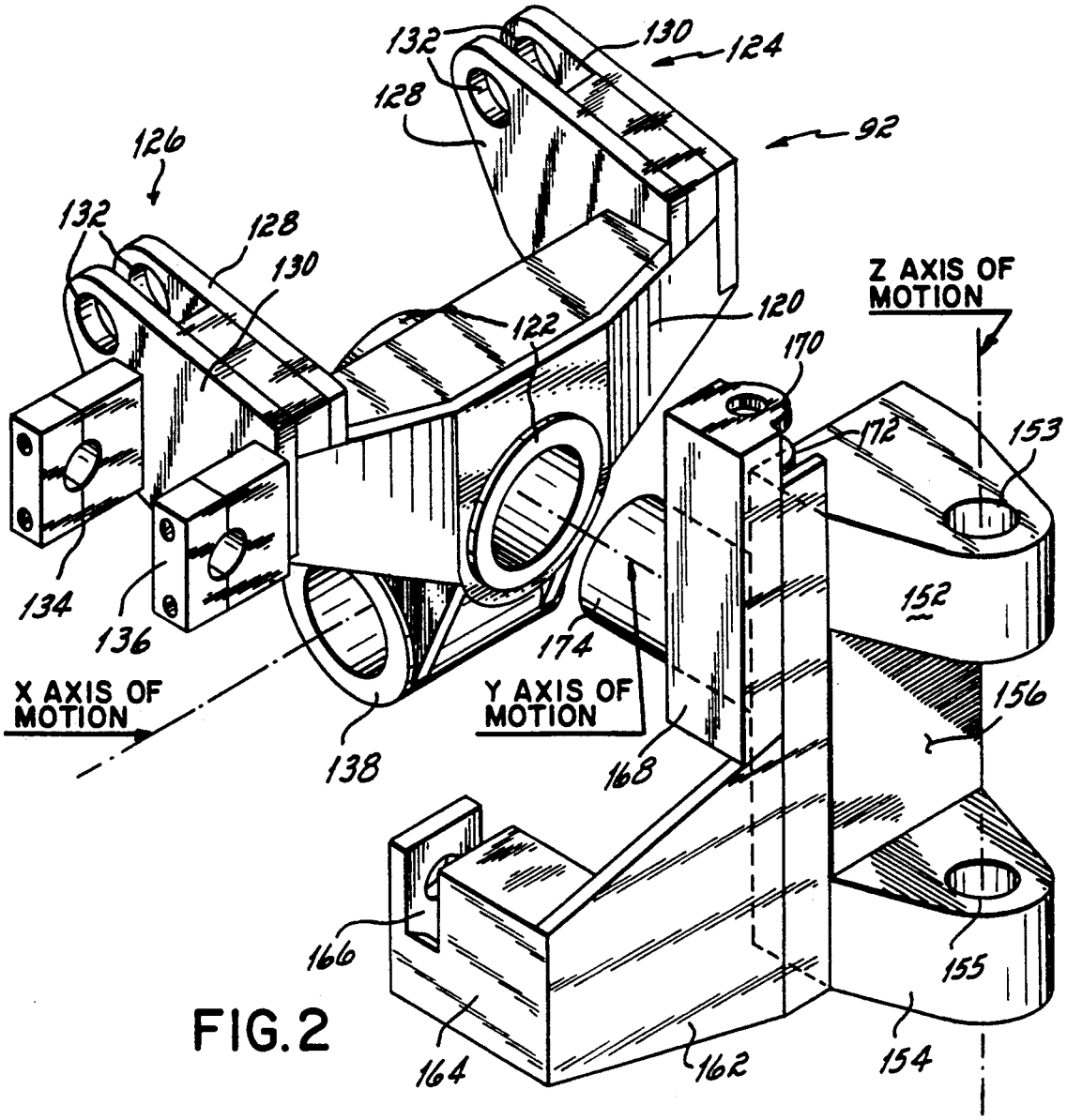
FIG. 2 is a partial, disassembled view of a portion of the structure for mounting the boom assembly to the digger arm.
Figure 3:
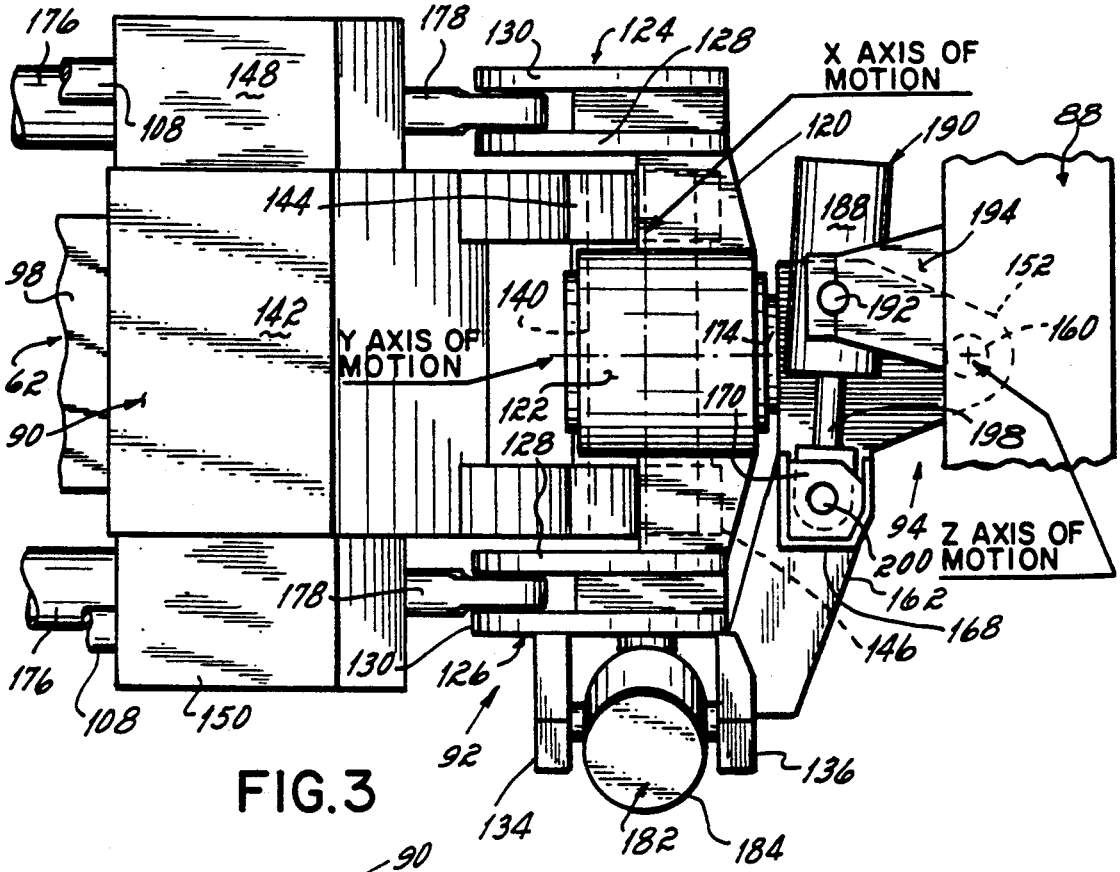
FIG. 3 is an enlarged view of the structure for mounting the boom assembly to the digger arm taken generally along line 3—3 of FIG. 1.
Figure 4:
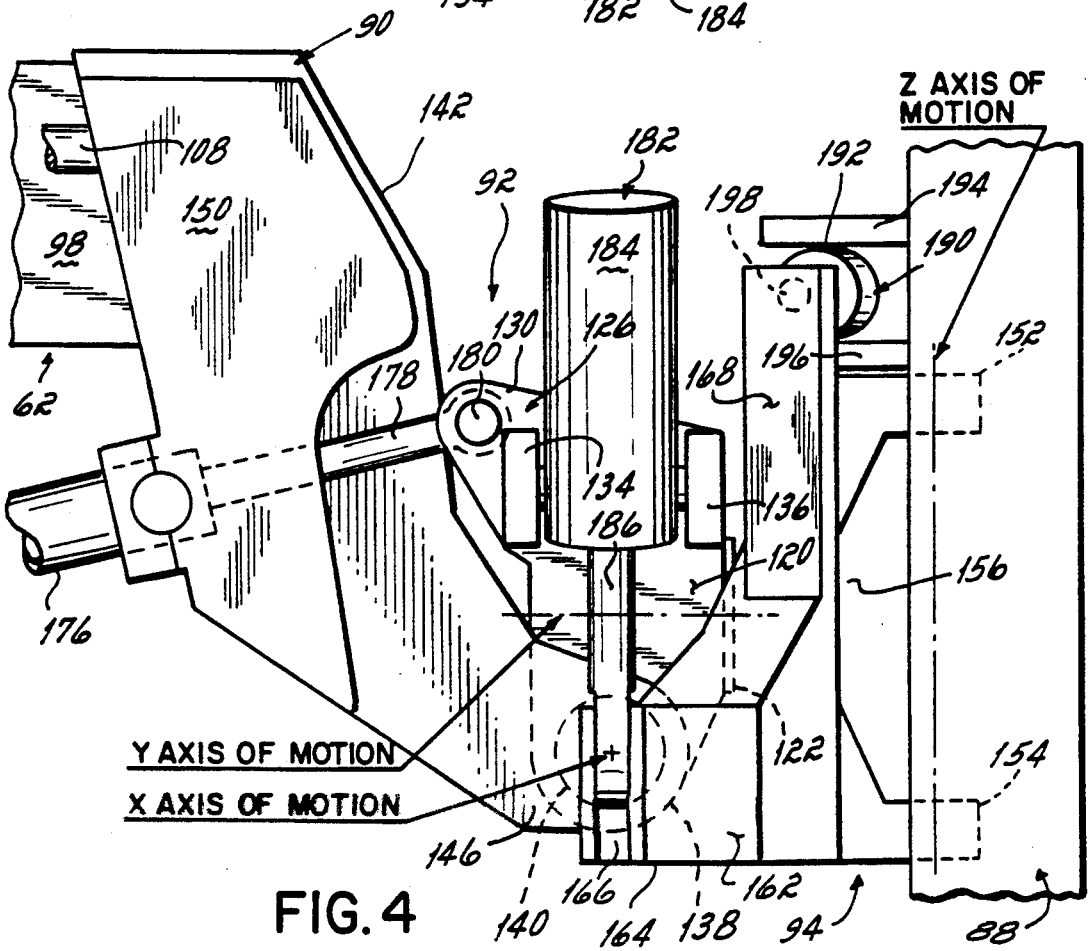
FIG. 4 is an enlarged, front view of the structure shown in FIG. 1 for mounting the boom assembly to the digger arm as seen along line 4—4 of FIG. 3.

With particular reference to FIGS. 2–4, the detailed structure of boom mounting bracket 90, coupler 92 and digger arm bracket 94 is illustrated. As mentioned above, these elements are employed to manipulate the digger arm 88 about a number of axes. For purposes of the present discussion, such manipulation will be described in terms of pivotal movement about an X axis, a Y axis and a Z axis which are mutually perpendicular and are labeled in the various Figs. As will be described in detail below, pivotal motion of the digger arm 88 about these axes is necessary in order to maintain the digger arm 88 substantially vertical, and perpendicular to ground level, as the digger arm 88 is first inserted from ground level to the appropriate trench depth and then propelled along a given trench line in order to form a trench.

As viewed in FIG. 2, the coupler 92 comprises a coupler body 120 which mounts a cylindrical tube 122 whose longitudinal axis is coincident with the Y axis mentioned above. The ends of the coupler body mount a first yoke 124 and a second yoke 126 which are spaced from one another and located on either side of the cylindrical tube 122. The first and second yokes 124, 126 each include a pair of spaced, parallel plates 128, 130 formed with aligning throughbores 132. The second yoke 126 carries a pair of spaced mounting blocks 134 and 136, the purpose of which is described below. Located on the coupler body 120 beneath cylindrical tube 122 is a sleeve 138 formed with a throughbore which rotatably receives a shaft 140 having a longitudinal axis coincident with the X axis. See FIG. 4.

As viewed in FIGS. 3 and 4, and mentioned above, the coupler 92 is interposed between the boom mounting bracket 90 and digger arm bracket 94 so as to interconnect the boom assembly 62 and digger arm 88. Considering first the interconnection between the boom mounting bracket 90 and coupler 92, the boom mounting bracket 90 comprises a center section 142 having a first arm 144 and second arm 146 extending outwardly therefrom which pivotally mount on the shaft 140 carried within the sleeve 138 of coupler 92. A pair of side sections 148, 150 are mounted on either side of the center section 142 of boom mounting bracket 90 which are pivotally connected to rods 108 of the linear actuators 102, 104, respectively, of the boom assembly 62. The side sections 148, 150 also carry X axis actuators, the structure and operation of which is described in more detail below.

The coupler 92 is also pivotally connected to the digger arm bracket 94 as best seen in FIGS. 2–4. The digger arm bracket 94 comprises an upper flange 152, a lower flange 154 and an upright plate 156 extending therebetween. The upper and lower flanges 152, 154 are each formed with a throughbore 153, 155, respectively, so that a pin 160 can be inserted through the flanges 152, 154 to connect the digger arm bracket 94 to the digger arm 88. The longitudinal axes of bores 153, 155, and pin 160, are all coincident with the Z axis.

In the presently preferred embodiment, the upper and lower flanges 152, 154 and upright flange 156 are welded or otherwise permanently affixed to a base 162 including a bracket extension 164 formed with a slot 166. The base 162 mounts a cylinder support 168 having a pair of spaced ears 170, 172 for purposes to become apparent below. A pivot pin 174 of digger arm bracket 90 extends outwardly from the side of upright plate 156 opposite flanges 152, 154. This pivot pin 174 is rotatable within the cylindrical tube 122 of coupler 92. As depicted in FIG. 2, the longitudinal axes of the pivot pin 174 and cylindrical tube 122 are coincident with the Y axis.

Pivotal Motion of Digger Arm

Having described the structure of the boom mounting bracket 90, coupler 92 and digger arm bracket 94, reference is made to FIGS. 3 and 4 for a description of the structure associated with these elements which produces pivotal movement of the digger arm 88 with respect to the X, Y and Z axes. Considering first the pivotal motion of digger arm 88 about the X axis, each of the side sections 148 and 150 of boom mounting bracket 90 carries an X axis linear actuator, such as an hydraulic or pneumatic cylinder 176, at a slightly upwardly directed angle with respect to the coupler 92. The cylinder rod 178 of each X axis cylinder 176 is connected to one of the first and second yokes 124, 126 of coupler 92 by a pin 180 insertable through the throughbores 132 of the plates 128, 130 forming such yokes 124, 126.

Figure 7:
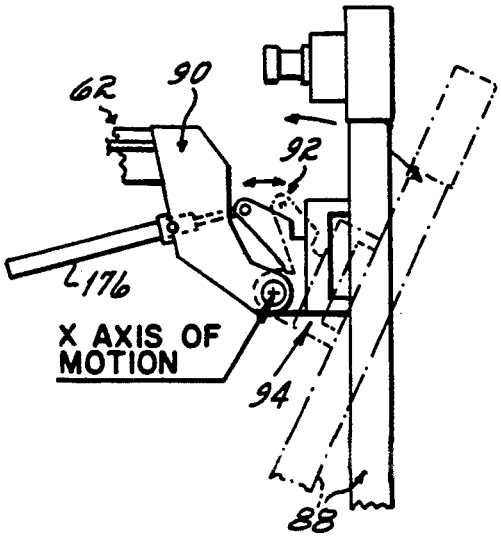
FIG. 7 is a schematic view of pivotal motion of the digger arm with respect to the X axis.

In response to extension and retraction of the X axis cylinder rods 178, the coupler 92 is pivoted with respect to the X axis as its sleeve 138 pivots on the shaft 140 connected to the first and second arms 144, 146 of boom mounting bracket 90. As mentioned above, the longitudinal axes of sleeve 138 and shaft 140 are coincident with the X axis, and the sleeve 138 and shaft 140 are pivotal relative to one another. Because the digger arm bracket 94 is connected to the coupler 92 by the pivot pin 174 inserted within the cylindrical tube 122 of coupler 92, the digger arm 88 is pivoted about the X axis with the coupler 92 as the coupler 92 pivots on shaft 140. This pivotal motion of the digger arm 88 with respect to the X axis is schematically depicted in FIG. 7.

Figure 8:
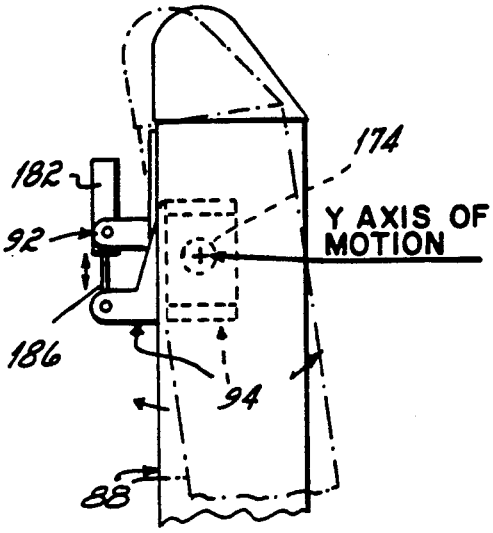
FIG. 8 is a schematic view of the motion of the digger arm about the Y axis.

Pivoting of the digger arm 88 with respect to the Y axis is obtained by a Y axis cylinder 182 as best shown in FIGS. 3 and 4. The housing 184 of Y axis cylinder 182 is pivotally mounted to the mounting blocks 134, 136 of coupler 92, and the cylinder rod 186 of Y axis cylinder 182 is connected by a pin within the slot 166 of the bracket extension 164 of digger arm bracket 94. In response to extension and retraction of the Y axis cylinder rod 186, the digger arm 88 is pivoted about the Y axis through the connection between Y axis cylinder rod 186, bracket extension 164 and the remainder of digger arm bracket 94. The boom mounting bracket 90 and coupler 92 remain fixed with respect to the Y axis, and thus maintain the Y axis cylinder housing 184 in a fixed position relative to the Y axis. Rotation or pivoting movement of the digger arm 88 with respect to the Y axis is permitted, however, because the digger arm bracket 94 is pivotally connected to the coupler 92 via the digger arm pivot pin 174. As noted above, the pivot pin 174 is rotatable within the cylindrical tube 122 of coupler 92, and the longitudinal axes of both the pivot pin 180 and tube 122 are coincident with the Y axis. See also FIG. 2. This pivotal motion of digger arm 88 with respect to the Y axis is schematically depicted in FIG. 8.

Rotation or pivoting motion of the digger arm 88 with respect to the Z axis is obtained as follows. Preferably, the housing 188 of a Z axis cylinder 190 is pivotally mounted by pins 192 between a pair of spaced Z axis mounting plates 194 and 196 fixed to the digger arm 88. The cylinder rod 198 of Z axis cylinder 190 is received between the spaced ears 170, 172 carried by the cylinder mount 168 of digger arm bracket 94 and secured thereto by a pin 200. See also FIG. 2. In response to extension and retraction of the Z axis cylinder rod 198, the digger arm 88 pivots about the Z axis on the pin 160 extending between the upper and lower flanges 152, 154 of digger arm bracket 94. This is because the housing 188 of Z axis cylinder 190 is connected directly to the digger arm 188 via plates 194, 196, whereas the digger arm bracket 94 which supports the cylinder rod 198 of the Z axis cylinder 190 is held in a fixed position with respect to the Z axis by the cylinder rod 186 of Y axis cylinder 182. The Y axis cylinder 182, including its cylinder rod 186, are maintained in a fixed position with respect to rotation about the Z axis by the coupler 92 and boom mounting bracket 90. Accordingly, the digger arm 88 rotates about the Z axis on the fixed upper and lower flanges 152, 154 of digger arm bracket 94 in response to actuation of the Z axis cylinder 190.

Trenching Operation Including Slewing

The trenching apparatus 10 of this invention is capable of forming an essentially continuous trench 96 at a trench depth in excess of 20 feet, and is particularly advantageous when used at excavation sites where the trench must form corners and/or wherein obstructions are present such as buildings or other structures adjacent the excavation site. As discussed, for example, in U.S. Pat. Nos. 4,681,483 and 4,843,742 to Camilleri, the trenching operation is initiated by operating the digger arm 88 to dig downwardly from ground level to the desired trench depth. Thereafter, the digger arm 88 is propelled along a trench line by the support base 12 and boom assembly 62 acting on the upper portion of the digger arm 88, and a digger and propulsion unit (not shown) acting below ground on the lower end of the digger arm 88. In order to form corners at an excavation site, a slewing operation is performed in the manner depicted in FIGS. 5 and 6 and described below.

Considering first the requirements involved with initially inserting the digger arm 88 to trench depth and then propelling the digger arm 88 along a trench line, reference is made to FIG. 1. Initially, the cylinder rod 114 of lift cylinder 110 is extended to raise the boom assembly 62 about its pivotal connection to the bracket 60 of hinge 48. This, in turn, positions the digger arm 88 above ground level. The digger arm 88 is then operated to begin digging, and is lowered to the desired trench depth by retracting the cylinder rod 114 of lift cylinder 110 so that the boom assembly 62 pivots downwardly. In order to maintain the digger arm 88 substantially perpendicular to ground level, the X axis cylinders 176 are activated as described above to pivot the digger arm 88 about the X axis. See also FIG. 7. Such pivotal movement of the digger arm 88 about the X axis is necessary to maintain the digger arm 88 essentially vertical as the lift cylinder 10 is retracted because the boom assembly 62 travels in an arc-shaped path as it pivots about bracket 60 in moving from the raised position to the lowered position with respect to ground level. During this movement, the inner boom 98 telescopes within the outer boom 100 as required to maintain the digger arm 88 at the proper trenching position.

Once the digger arm 88 has reached the appropriate trench depth, it is propelled along a first trench line 202 by operation of the support base 12 and a digging and propulsion unit (not shown). See FIG. 5. It is contemplated that obstructions such as rocks or other materials below ground may periodically necessitate adjustment of the position of digger arm 88 in order to maintain it substantially vertical with respect to ground level. For example, the lower end of digger arm 88 may trail the upper end if an obstruction is contacted, and the Y axis cylinder 182 is effective to pivot the digger arm 88 about the Y axis as schematically depicted in FIG. 8 to account for such conditions and maintain the digger arm 88 perpendicular. Similarly, the X axis cylinder 176 or the Z axis cylinder 190 can be actuated as described above to pivot the digger arm 88 about the X or Y axis should any misalignment occur in those directions while the digger arm 88 is at trench depth performing a trenching operation.

An important aspect of this invention involves the performance of a "slewing" operation by the trenching apparatus 10 herein which is necessary in order to form a corner in an excavation site where the first trench line 202 intersects a second trench line 204 at some angle. With reference to FIGS. 5 and 6, a "slewing" operation is performed as follows. Initially, movement of the support base 12 parallel to the first trench line 202 is discontinued and the support base 12 is temporarily maintained in a stationary position. The boom swing cylinder 72 is then actuated to swing the boom assembly 62 about an arc-shaped path 206 illustrated in phantom in FIG. 5. As described above, the boom swing cylinder 72 is effective to pivot the hinge 48 relative to the hitch 38, and the hinge 48 carries with it the boom assembly 62. In order to move along this arc-shaped path 206 while maintaining the digger arm 88 perpendicular to ground level and coincident with the first trench line 202, at least two manipulations of the digger arm 88 must be performed. First, the boom assembly 62 must be extended from a retracted position shown in solid lines in FIG. 5 to an extended position shown in phantom in FIG. 5 Such extension of the boom assembly 62 is achieved by activating linear actuators 102, 104 which telescope inner boom 98 outwardly with respect to outer boom 100. This allows the digger ar 88 carried at the end of the boom assembly 62 to follow the first trench line 202 throughout the arc-shaped path 206 of travel of the boom assembly 62. Additionally, the digger arm 88 must be pivoted about the Z axis as the boom assembly 62 moves along the arc-shaped path 206 so that the sides of the digger arm 88 are maintained parallel to the trench 96 formed along the first trench line 202. Such pivotal motion of digger arm 88 about the Z axis is obtained by operation of the Z axis cylinder 190 as described in detail above.

When the digger arm 88 has reached the intersection of the first and second trench lines 202, 204, the lift cylinder 110 is extended to remove the digger arm 88 from the trench 96. The support base 12 is then moved to a position wherein its track assemblies 22, 24 are substantially parallel to the second trench line 204 and the back or rearward portion of the support base 12 faces the trench 96 formed along the first trench line 202. See FIG. 6. The boom swing cylinder 72 is then activated to move the boom assembly 62 from a position at the forward end of support base 12, depicted in phantom lines in FIG. 5, to a position at the rearward end of support base 12 depicted in solid lines in FIG. 6. In this position at the rearward side of support base 12, the digger arm 88 carried by the boom assembly 62 is located directly over the intersection of the first and second trench lines 202, 204. The digger arm 88 is the inserted from above ground level to the desired trench depth, as described above, to begin formation of a second trench 208 along the second trench line 204.

It should be noted that in the course of movement of the boom assembly 62 from a forward position relative to the support base 12 shown in FIG. 5 and the rearward position shown in FIG. 6, the Z axis cylinder 190 is activated to pivot the digger arm 88 with respect to the Z axis so that it changes position relative to the coupler 92 and digger arm bracket 94 from that shown in phantom lines in FIG. 5 to that shown in solid lines in FIG. 6. This maintains the sides of the digger arm 88 substantially parallel to the line 204 of second trench 208 throughout such swinging movement of the boom assembly 62.

After the digger arm 88 has reached trench depth at the intersection of first and second trench lines 202, 204, the boom swing cylinder 72 is actuated to swing the boom assembly 62 along a second arc-shaped path 210 shown in dotted lines in FIG. 6. This pivotal movement of boom assembly 62 and hinge 48 relative to the fixed hitch 38 allows the boom assembly 62 to travel from a position rearward of the support base 12 to a position substantially perpendicular thereto as depicted in phantom lines in FIG. 6. During this transit along arc-shaped path 210, the inner boom 98 is retracted within outer boom 100 and the Z axis cylinder 190 is actuated to pivot the digger arm 88 about the Z axis as required to maintain the sides of the digger arm 88 substantially parallel to the second trench line 204. Once the boom assembly 62 reaches a position perpendicular to support base 12 as shown in phantom in FIG. 6, the support base 12 is operated to move along the second trench line 204 to form the completed, second trench 208.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. Apparatus for digging a trench, comprising:

a support base movable along a trench line, said support base carrying a fixed hitch and a hinge pivotally mounted to said hitch;

a digger arm having an upper end and a lower end, said digger arm being insertable below ground for digging the trench in the direction of movement of said support base, said digger arm being pivotal with respect to an X axis, a Y axis and a Z axis which are perpendicular to one another;

a boom pivotally connected to said hinge, said boom having a boom mounting bracket;

a coupler connected between said boom mounting bracket and said upper end of said digger arm, said coupler being pivotal relative to said boom mounting bracket about said X axis and restrained by said boom mounting bracket from pivotal movement relative to the Y and Z axes;

first pivot means, carried by said boom mounting bracket, for pivoting said coupler and said digger arm relative to said X axis;

second pivot means, carried by said coupler, for pivoting said digger arm relative to said Y axis while said coupler and said boom mounting bracket remain stationary relative to said Y axis;

third pivot means, connected between said digger arm and said coupler, exerting a force in a direction offset from said Z-axis for pivoting said digger arm relative to said Z axis while said coupler and said boom mounting bracket remain stationary relative to said Z axis.

2. The apparatus of claim in which said coupler comprises:

a coupler body;

a cylindrical tube carried by said coupler body, said tube having a longitudinal axis coincident with said Y axis;

a sleeve carried by said coupler body, said sleeve having a longitudinal axis coincident with said X axis;

a shaft rotatably mounted within said sleeve.

3. The apparatus of claim 2 in which said boom mounting bracket includes a pair of spaced arms mounted to said shaft of said coupler, said first pivot means including at least one linear actuator having a housing mounted to said boom mounting bracket and a cylinder rod connected to said coupler body, said cylinder rod being extendable and retractable to pivot said coupler body on said shaft relative to said X axis, which, in turn, pivots said digger arm relative to said X axis.

4. The apparatus of claim 2 in which said digger arm includes a pivot pin rotatable within said tube of said coupler about said Y axis, said second pivot means comprising a Y axis linear actuator having a housing fixed to said coupler body and a cylinder rod connected to said digger arm, said cylinder rod being extendable and retractable to pivot said digger arm relative to said Y axis as said pivot pin thereof pivots within said tube of said coupler while said coupler and said boom mounting bracket remain stationary relative to said Y axis.

5. The apparatus of claim 2 in which said digger arm includes a digger arm bracket connected to said cylinder rod of said Y axis linear actuator and mounted to said digger arm for pivotal movement relative to said Z axis, said third pivot means comprising a Z axis linear actuator having a housing connected to said digger arm and a cylinder rod connected to said digger arm bracket, said cylinder rod being extendable and retractable to pivot said digger arm relative to said Z axis on said digger arm bracket.

6. Apparatus for digging a trench, comprising:

a support base movable along a trench line, said support base carrying a fixed hitch and a hinge pivotally mounted to said hitch;

a digger arm having an upper end and a lower end, said digger arm being insertable below ground for digging the trench in the direction of movement of said support base, said digger arm being pivotal with respect to an X axis, a Y axis and a Z axis which are perpendicular to one another;

a digger arm bracket mounted to said upper end of said digger arm for pivotal movement relative to said Z axis, said digger arm bracket being rotatably fixed relative to said digger ar about said X and Y axes;

a boom pivotally connected to said hinge, said boom having a boom mounting bracket;

means for swinging said hinge and said boom in an arc-shaped path with respect to said support base;

a coupler connected between said boom mounting bracket and said digger arm bracket at said upper end of said digger arm, said coupler being pivotal relative to said boom mounting bracket about said X axis and restrained by said boom mounting bracket from pivotal movement relative to the Y and Z axes;

first pivot means, connected between said boom mounting bracket and said coupler, for pivoting said coupler and said digger arm relative to said X axis;

second pivot means, connected between said coupler and said digger arm bracket, for pivoting said digger arm relative to said Y axis while said coupler and said boom mounting bracket remain stationary relative to said Y axis;

third pivot means, connected between said digger arm and said coupler, exerting a force in a direction offset from said Z-axis for pivoting said digger arm relative to said Z axis while said coupler and said boom mounting bracket remain stationary relative to said Z axis.

7. The apparatus of claim 6 in which said coupler comprises:

a coupler body;

a cylindrical tube carried by said coupler body, said tube having a longitudinal axis coincident with said Y axis;

a sleeve carried by said coupler body, said sleeve having a longitudinal axis coincident with said X axis;

a shaft rotatably mounted within said sleeve.

8. The apparatus of claim 7 in which said boom mounting bracket includes a pair of spaced arms mounted to said shaft of said coupler, said first pivot means including at least one linear actuator having a housing mounted to said boom mounting bracket and a cylinder rod connected to said coupler body, said cylinder rod being extendable and retractable to pivot said coupler body on said shaft relative to said X axis, which, in turn, pivots said digger arm relative to said X axis.

9. The apparatus of claim 6 in which said digger arm includes a pivot pin rotatable within said tube of said coupler about said Y axis, said second pivot means comprising a Y axis linear actuator having a housing fixed to said coupler body and a cylinder rod connected to said digger arm bracket, said cylinder rod being extendable and retractable to pivot said digger arm relative to said Y axis as said pivot pin thereof pivots within said tube of said coupler while said coupler and said boom mounting bracket remain stationary relative to said Y axis.

10. The apparatus of claim 6 in which said digger arm includes at least on mounting plate fixed thereto, said third pivot means comprising a Z axis linear actuator having a housing connected to said at least on mounting plate fixed to said digger arm and a cylinder rod connected to said digger arm bracket, said cylinder rod being extendable and retractable to pivot said digger arm relative to said Z axis on said digger arm bracket while said digger arm bracket is maintained in a pivotally fixed position relative to said Z axis by said coupler.

11. The apparatus of claim 6 in which said means for swinging said boom comprises a linear actuator connected between said support base and said hinge.

12. The method of claim 11 in which said step of inserting the digger arm into the ground to the desired trench depth at the intersection of the first and second trench lines includes first swinging the boom structure from its position forward of the support base to a position rearward of the support base.

13. A method of digging a trench, comprising:

inserting a digger arm at least partially below ground to a desired trench depth;

advancing a movable support base in a first direction so that the digger arm, mounted to a boom structure carried by the support base, forms a first trench along a first trench line in the first direction of movement;

stopping the movement of the support base in the first direction;

swinging the boom structure relative to the support base in a first arc-shaped path from a position alongside the support base to a position forward of the support base which further advances the digger arm in the first direction;

pivoting the digger arm in the course of movement of the boom structure in the first arc-shaped path so that the digger arm is maintained substantially parallel to the first trench line;

removing the digger arm from the first trench;

moving the support base to a position substantially parallel to a second trench line which is oriented at an angle to the first trench line;

inserting the digger arm into the ground to the desired trench depth at the intersection of the first and second trench lines;

swinging the boom structure relative to the support base in a second arc-shaped path from a position rearwardly of the support base at the point of intersection of the first and second trench lines to a position alongside the support base;

pivoting the digger arm in the course of movement of the boom structure in the second arc-shaped path so that the digger arm is maintained substantially parallel to the second trench line;

moving the base support in a second direction along the second trench line to form a second trench; and wherein said step of swinging the boom structure relative to the support base in the first arc-shaped path comprises pivoting a hinge connected to the boom structure relative to a hitch fixed to the support base in a direction toward the forward portion of the support base, the boom structure swinging relative to the support base with such pivotal movement of the hinge.

14. A method of digging a trench, comprising:

inserting a digger arm at least partially below ground to a desired trench depth;

advancing a movable support base in first direction so that the digger arm, mounted to a boom structure carried by the support base, forms a first trench along a first trench line in the first direction of movement;

stopping the movement of the support base in the first direction;

swinging the boom structure relative to the support base in a first arc-shaped path from a position alongside the support base to a position forward of the support base which further advances the digger arm in the first direction;

pivoting the digger arm in the course of movement of the boom structure in the first arc-shaped path so that the digger arm is maintained substantially parallel to the first trench line;

removing the digger arm from the first trench;

moving the support base to a position substantially parallel to a second trench line which is oriented at an angle to the first trench line;

inserting the digger arm into the ground to the desired trench depth at the intersection of the first and second trench lines;

swinging the boom structure relative to the support base in a second arc-shaped path from a position rearwardly of the support base at the point of intersection of the first and second trench lines to a position alongside the support base;

pivoting the digger arm in the course of movement of the boom structure in the second arc-shaped path so that the digger arm is maintained substantially parallel to the second trench line;

moving the base support in a second direction along the second trench line to form a second trench; and wherein said step of swinging the boom structure relative to the support base in the second arc-shaped path comprises pivoting a hinge connected to the boom structure relative to a hitch fixed to the support base in a direction from the rearward portion toward the forward portion of the support base, the boom structure swinging relative to the support base with such pivotal movement of the hinge.

* * * * *

UNITED STATES PATENT AND TRADEMARK OFFICE

CERTIFICATE OF CORRECTION

PATENT NO. : 5,247,743

DATED : September 28, 1993

INVENTOR(S) : Randy J. Holloway and James E. Lowder

It is certified that error appears in the above-indentified patent and that said Letters Patent is hereby corrected as shown below:

Column 2, Line 58, "accurately an" should read --accurately and--.

Column 3, Line 13, "On aspect" should read --One aspect--.

Column 8, Line 58, "lift cylinder 10" should read --lift cylinder 110--.

Column 9, Line 41, "digger ar" should read --digger arm--.

Column 11, Line 14, "apparatus of claim in" should read --apparatus of claim 1 in--.

Column 11, Line 68, "digger ar" should read --digger arm--.

UNITED STATES PATENT AND TRADEMARK OFFICE

CERTIFICATE OF CORRECTION

PATENT NO. : 5,247,743

DATED : September 28, 1993

INVENTOR(S) : Randy J. Holloway and James E. Lowder

It is certified that error appears in the above-indentified patent and that said Letters Patent is hereby corrected as shown below:

Column 12, Line 57, "at least on mounting" should read

--at least one mounting--.

Column 12, Line 59, "at least on mounting" should read

--at least one mounting--

Signed and Sealed this

Nineteenth Day of July, 1994

*Attest:*

*Attesting Officer*

BRUCE LEHMAN

*Commissioner of Patents and Trademarks*